US007311197B1

(12) United States Patent
Wilkinson et al.

(10) Patent No.: US 7,311,197 B1
(45) **Date of Patent: *Dec. 25, 2007**

(54) FOLDABLE GARMENT DISPLAY PACKAGE AND METHOD FOR USE

(75) Inventors: Jeanne Wilkinson, Lewisville, NC (US); Alan Pamell, Mooresville, NC (US); Melanie Moore, Charlotte, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 411 days.

This patent is subject to a terminal disclaimer.

(21) Appl. No.: 10/645,218

(22) Filed: Aug. 21, 2003

Related U.S. Application Data

(63) Continuation-in-part of application No. 10/126,321, filed on Apr. 19, 2002, now Pat. No. 6,622,858, which is a continuation-in-part of application No. 09/650, 303, filed on Aug. 29, 2000, now abandoned.

(51) Int. Cl.
*B65D 85/18* (2006.01)

(52) U.S. Cl. ..... 206/299; 206/292; 206/288

(58) Field of Classification Search ..... 206/299, 206/292, 288, 278, 279, 284, 281; 229/101
See application file for complete search history.

(56) References Cited

U.S. PATENT DOCUMENTS 3,329,386 A 7/1967 Rosen (Continued)

OTHER PUBLICATIONS

*Sara Lee Corporation v. Maidenform, Inc., Maidenform International, Ltd., and Maidenform Online, Inc.*, Civil Action No. 1:03CV905 (M.D.N.C.), Complaint, filed Sep. 23, 2003.

(Continued)

*Primary Examiner*—Tri M. Mai
(74) *Attorney, Agent, or Firm*—Kilpatrick Stockton, LLP

(57) ABSTRACT

A foldable garment display package for displaying garments such as intimate apparel comprises a back panel, a bottom panel, and a front panel. The back panel includes a top, two sides, a bottom, a securing flap integrally formed as part of the back panel, a hanging tab integrally formed at the top of the back panel, and a closing slot formed proximate one side of the back panel. The bottom panel is foldably connected to the bottom of the back panel and upwardly foldable into juxtaposed relationship with the back panel. The front panel comprises an innermost edge foldably connected to the side of the back panel opposite the side on which the closing slot is located. The front panel also includes an outermost edge having a closing tab corresponding to the closing slot foldably connected to the outermost edge. At least one garment to be displayed is wrapped around the bottom panel. The bottom panel is then moved into an upwardly folded position, where the securing flap is folded over the bottom panel and the garment(s) to secure them in place. The front panel is then folded across the garments, the bottom panel, and the securing flap, and the closing tab is inserted into the closing slot so as to secure the garment(s) within the package and expose the garment(s) below the front panel. Such a foldable garment display package allows potential consumers ready access to the displayed garments, allowing them to both visually and tactilely inspect the garment(s) contained in the package, without having to open the package to do so.

2 Claims, 6 Drawing Sheets

U.S. PATENT DOCUMENTS

| | | | | |
|---|---|---|---|---|
| 4,014,436 | A | | 3/1977 | Tunis |
| 4,257,522 | A | | 3/1981 | Thorneburg |
| 4,590,610 | A | | 5/1986 | Rhyne |
| 4,742,914 | A | | 5/1988 | Klein |
| 5,485,919 | A | | 1/1996 | Samberg et al. |
| 5,499,484 | A | | 3/1996 | Herrin |
| 5,503,269 | A | | 4/1996 | DeBiasio |
| 5,515,966 | A | | 5/1996 | Hodge et al. |
| 5,791,470 | A | * | 8/1998 | Usui ..... 206/362.4 |
| 5,915,564 | A | | 6/1999 | His-Chang |
| 6,032,793 | A | | 3/2000 | Oakley |

OTHER PUBLICATIONS

*Sara Lee Corporation v. Maidenform, Inc., Maidenform International, Ltd., and Maidenform Online, Inc.*, Civil Action No. 1:03CV905 (M.D.N.C.), Answer, filed Dec. 1, 2003.

* cited by examiner

FOLDABLE GARMENT DISPLAY PACKAGE AND METHOD FOR USE

CROSS-REFERENCE TO RELATED APPLICATIONS

This patent application is a continuation-in-part application of, and claims priority to, U.S. patent application Ser. No. 10/126,321, filed Apr. 19, 2002 now U.S. Pat. No. 6,622,858, which is a continuation-in-part application of U.S. patent application Ser. No. 09/650,303, filed Aug. 29, 2000, now abandoned, each application entitled "Foldable Garment Display Package And Method For Use," and each of which is hereby incorporated herein by reference in its entirety.

FIELD OF THE INVENTION

The present invention relates generally to a package for displaying articles, and more specifically to a package for displaying intimate apparel for easy tactile and visual inspection.

BACKGROUND OF THE INVENTION

Customers in retail stores often desire to inspect the contents of a package prior to making a purchase. This is particularly true for articles of clothing such as intimate apparel. As a result of this desire, customers may attempt to open packages to view and touch garments contained therein. Examples of such display packages that are commonly used for intimate apparel include polymer bags and cardboard boxes. Such traditional means for packaging underwear often do not display garments in an exposed manner so that potential consumers can touch the garments in a store prior to purchase. Additionally, such containers cannot be easily opened, making products in such containers virtually inaccessible to touch by a customer. Consequently, many customers open containers in order to inspect the garments inside without repackaging the contents, or poorly repackage them, resulting in retail merchandise and packaging being left in disarray. Furthermore, while attempting to open packages in order to inspect garments, customers may even damage the package.

To address the customers' desire to both see and touch garments prior to purchase, packages may be designed to at least partially expose garments contained within the packages. Some package designs provide exposed garments that are secured within the package by a band, or narrow strip of material, that is wrapped around the package. In such a design, the packages are frequently susceptible to being torn, and/or the displayed garments are susceptible to being too easily removed by customers. Such disadvantages result in packaging and package contents being left in disarray.

One approach to sufficiently secure garments that are exposed for inspection by a display package is to fold garments about a foldable member of a package. Typically, foldable packages expose only one garment at a time for display. Additionally, foldable packages generally are not constructed to provide sufficient thickness dimensions for aesthetically containing folded garments and for sufficiently securing thick garments or multiple garments, especially when the garments are folded.

Visual and tactile inspection of garments in display packages can be optimized by hanging the packages on a display rack. Many display packages, such as polymer bags and cardboard boxes, use a separate rigid plastic hanger to form a hangable display package. While two-piece packages using separate hanger means provide a hangable display package, such packages are usually more expensive to manufacture than packages having an integral hanging mechanism.

Thus, there is a need to provide a garment display package that is foldable, that is hangable on a display rack, and that permits consumers to both see and touch the displayed garments. It is also desirable to provide some means in such a package to accommodate and securely display multiple garments having some thickness, including folded garments, at the same time. It is to these perceived needs that the present invention is directed.

The present invention relates to foldable garment display packages that allow for visual and tactile inspection of the package contents, a feature that is particularly advantageous for packaging and displaying intimate apparel, such as underwear, in a retail environment.

SUMMARY OF THE INVENTION

The present invention relates to display packages for displaying articles. An embodiment of the present invention provides a foldable garment display package that allows potential consumers ready access to the displayed garments, allowing them to both see and touch the fabric of the garments without needing to open, and potentially damage, the packaging.

A display package of the present invention comprises a receptacle for holding an article, or group of articles, to be displayed. The receptacle includes an opening that allows a portion of the article(s) to be touched or handled while the article(s) remains properly and securely packaged. The display package may further comprise an opening, hook or other similar feature for hangably mounting the display package in a retail display environment.

A display package of the present invention may be formed from a single blank, for example, from cardboard, having foldable panels with various aspects of the display package cut therein. One embodiment of the present invention comprises a back panel, a bottom panel, and a front panel. The back panel includes a top, two sides, a bottom, a securing flap integrally formed as part of the back panel, a hanging tab integrally formed at the top of the back panel, and a closing slot integrally formed proximate one side of the back panel. The hanging tab is preferably formed as a hook having a substantially "J" shape, but may also comprise an aperture having a substantially circular or oblong shape, or other suitable shape. The bottom panel is foldably connected to the bottom of the back panel and upwardly foldable into adjacent, or juxtaposed, relationship with the back panel. The front panel comprises an innermost edge and an outermost edge. The innermost edge of the front panel is foldably connected to a side of the back panel opposite the side of the back panel on which the closing slot is located. The front panel also includes a closing tab corresponding to the closing slot foldably connected to the outermost edge of the front panel. The closing slot and closing tab may have corresponding shapes; for example, both the closing tab and the closing slot may be arcuate in shape. In such an embodiment, the present invention allows one or more garments to be wrapped around the bottom panel and be displayed in an upwardly folded position, where the bottom panel and the garment(s) are held in place by the securing flap. Once the one or more garments are wrapped around the bottom panel and flipped into an upwardly folded position, the securing flap can be flipped down over the bottom panel and the garment(s) to help keep dust off them and hold them in position. The front panel may then be folded across a top portion of the perimeter of the garment(s), the bottom panel, and the securing flap, and finally, the closing tab can be inserted into the closing slot to secure the garment(s) within the package.

In another embodiment of the present invention, the back panel of a garment display package comprises a first portion and a second portion of approximately equal size. The two portions may be folded together along a back panel fold line so as to be in substantial alignment with one another. The two portions may be permanently fixed together, for example, by gluing, to provide a composite back panel having double thickness. A double thickness composite back panel as in the present invention provides the advantage of added support to the hanging tab and closing slot formed therein.

One embodiment of the present invention includes a bottom panel that is foldably connected to the bottom of a back panel by a connecting tab. The connecting tab has a common fold line with the back panel and a separate common fold line with the bottom panel so that folding the connecting tab along each of the common fold lines provides a package thickness dimension. Such a package thickness dimension allows a garment display package of the present invention to display thicker garments, as well as multiple garments, and particularly multiple folded garments.

In an embodiment of the present invention, a front panel may comprise at least two fold lines located proximate each of the innermost edge and the outermost edge of the front panel. Fold lines located proximate each edge are spaced apart so that folding the front panel at the fold lines provides a thickness dimension to accommodate garments for display. In a preferred embodiment, the front panel comprises at least three fold lines located proximate each of the innermost edge and the outermost edge. One of the at least three fold lines located proximate each edge is an intermediate fold line positioned between a rearward fold line and a forward fold line at each edge. In the preferred embodiment, three fold lines located proximate each edge are spaced apart so that folding the front panel along the three fold lines provides a variable thickness dimension to accommodate garments for display. The intermediate fold line near each edge is capable of flexing to allow the front panel to accept garments of different thicknesses.

In an embodiment of the present invention, each of the back, bottom, and front panels has a respective length. In a preferred embodiment, the length of the front panel is less than the length of the back panel, and the front panel is foldably connected along a portion of the length of the back panel. When the front panel is folded across a top portion of the perimeter of the garment(s) that is in an upwardly folded position, a portion of the garment(s) is exposed below the front panel for display, thereby allowing consumers to visually and tactilely inspect the displayed garment(s) without needing to open the packaging to do so. The length and placement of the front panel relative to the back and bottom panels holds the garments in place while allowing sufficient exposure of the garments for inspection. Garments can thus be reliably retained within a foldable display package with a one-piece front panel, as in the present invention. Additionally, the length of the front panel in the present invention is sufficient to allow room for product information and advertising indicia to be displayed thereon.

An embodiment of a method for using a foldable garment display package according to the present invention comprises providing a garment display package having a back panel, a bottom panel, and a front panel. The back panel has a top, two sides, a bottom, a securing flap preferably integrally formed as part of the back panel, a hanging tab preferably integrally formed at the top of the back panel, and a closing slot formed proximate one side of the back panel. The bottom panel is foldably connected to the bottom of the back panel and is upwardly foldable into juxtaposed relationship with the back panel. The front panel has an innermost edge and an outermost edge, the innermost edge being foldably connected to the side of the back panel opposite the closing slot. The front panel also includes a closing tab corresponding to the closing slot foldably connected to the outermost edge of the front panel.

For displaying articles, such an embodiment further comprises positioning at least one garment about or around the bottom panel; flipping the securing flap up and out of the way of the area where the bottom panel will be folded up into juxtaposed relationship with the back panel; folding the bottom panel and the one or more garments wrapped therearound upward into juxtaposed relationship with the back panel; flipping the securing flap down over the top of the bottom panel and the one or more garments wrapped therearound to help secure them in their upwardly folded position and to help keep dust and debris from settling on the garment(s); folding the front panel transversely across a top portion of the outer perimeter of the garments and the bottom panel; inserting the closing tab into the corresponding closing slot in the back panel to secure the garments, bottom panel, securing flap and front panel into position for displaying; and placing the package onto a display rack via the hanging tab. The garments are exposed below the front panel of the closed package for display, and are thereby readily accessible to customers for both viewing and touching. Therefore, there is no real need for customers to open the packaging to inspect the garments contained therein.

In an embodiment, a method for using a foldable garment display package as in the present invention also comprises a bottom panel foldably connected to the bottom of a back panel with a connecting tab. The connecting tab has a common fold line with the back panel and a separate common fold line with the bottom panel. Folding the bottom panel and the garment(s) wrapped therearound upward into juxtaposed relationship with the back panel further comprises folding the connecting tab along each common fold line to provide a package thickness dimension. Such a package thickness dimension allows a garment display package of the present invention to display thicker garments, as well as multiple garments, and in particular, multiple folded garments.

A method for using a foldable garment display package as in the present invention may also include providing a front panel having at least two fold lines located proximate each of the innermost edge and the outermost edge. The fold lines located proximate each edge are spaced apart so that folding the front panel at the fold lines provides a thickness dimension to accommodate thicker, folded, and/or multiple garments for display.

In an embodiment of a method of the present invention, each of the back, bottom, and front panels has a respective length. In a preferred embodiment, the length of the front panel is less than the length of the back panel, and the front panel is foldably connected to the back panel along a portion of the length of the back panel. Folding the front panel across the bottom panel and a top portion of the outer perimeter of the garment(s) in their upwardly folded position exposes the garment(s) below the front panel for display, thereby enabling visual and tactile inspection of the displayed garment(s) by consumers.

An embodiment of a method according to the present invention that includes positioning at least one garment about or around a bottom panel, as described above, may further comprise positioning at least two garments about the bottom panel. Each of the at least two garments may be folded or wrapped about varying locations along the length of the bottom panel so that each garment is displayed in a layered fashion.

A garment display package as in the present invention provides numerous advantages over prior display packages. For example, a foldable garment display package of the present invention advantageously allows a potential consumer ready access to a displayed garment to visually inspect and touch the fabric of the garment without needing to open the packaging to do so. Providing for such easy visual and tactile inspection of packaged garments decreases the likelihood that customers will attempt to remove garments from their packaging. This helps keep product displays neat and organized, and also prevents packaging from becoming disheveled and/or destroyed.

Another advantage of the present invention is that displayed garments are secured within a package such that the garments are sufficiently exposed for inspection, yet are not too easily removed by customers. Use of a front panel having dimensions to cover a sufficient portion of garments to reliably retain the garments, an upwardly foldable bottom panel, a securing flap, and a closing tab and corresponding closing slot facilitate displayed garments remaining intact within packages as in the present invention.

Another advantage is that foldable garment display packages of the present invention provide a package thickness that allows aesthetic display of folded garments, thick garments, and multiple garments, especially when multiple garments are folded. The present invention also provides the advantage of allowing more than one garment at a time to be displayed in a layered fashion so that portions of each garment are visible and accessible to be touched by a consumer.

Another advantage of foldable garment display packages of the present invention is that, in some embodiments, an integral hanging tab provides for quick and easy display of packages on a display rack, further enhancing customer accessibility to garments for inspection.

Another advantage of foldable garment display packages of the present invention is that, in some embodiments, a securing flap helps keep dust and debris from settling on the packaged garments, while also providing better, or more secure, retention of the garments in the package.

Foldable garment display packages of the present invention may be formed from a single blank. Moreover, providing a double-thickness back panel, as in some embodiments of the present invention, provides increased support for an integral hanging tab and a closing slot formed therein. Thus, another advantage of the present invention is that foldable garment display packages can be efficiently and economically manufactured and used.

Further aspects and advantages of the present invention will be more readily apparent to those skilled in the art during the course of the following description, with references being made to the accompanying drawings which illustrate some preferred forms of the present invention and wherein like characters of reference designate like parts throughout the drawings. As will be realized by those skilled in the art, many different embodiments of a foldable garment display package and method for use according to the present invention are possible. Preferred embodiments of a foldable garment display package and method for use of the present invention will include one or more of the following features.

DETAILED DESCRIPTION OF THE INVENTION

The present invention provides garment display packages that are foldable, hangable, allow both visual and tactile inspection of displayed garments by customers, secure garments having some thickness to them, keep dust from settling on the displayed garments, and that are efficiently and economically made. Methods for use of foldable garment display packages according to the present invention are also provided.

Figure 1:
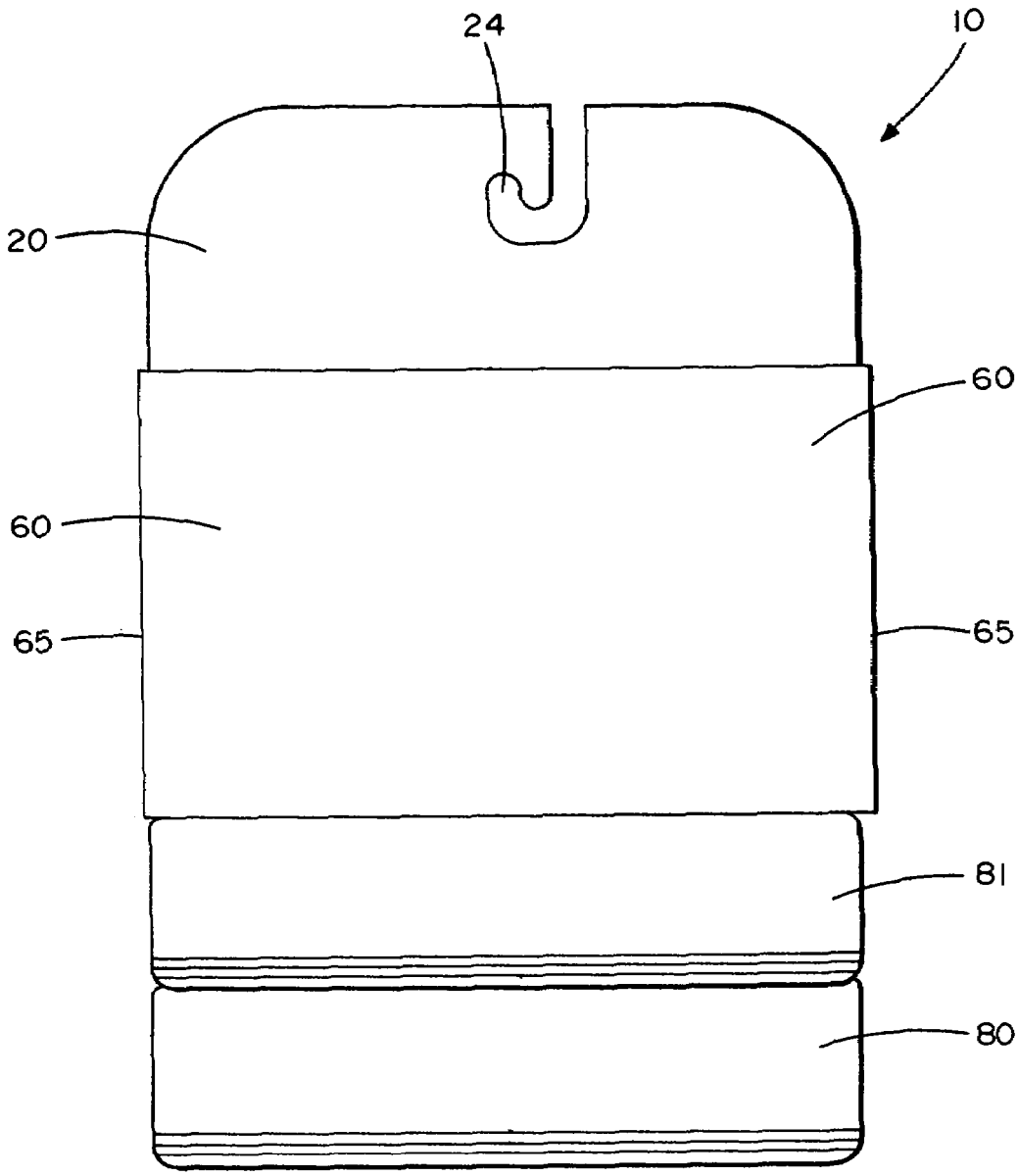
FIG. 1 is a front view of an embodiment of a garment display package of the present invention, showing two sets of underwear in a folded and displayed position.
Figure 2:
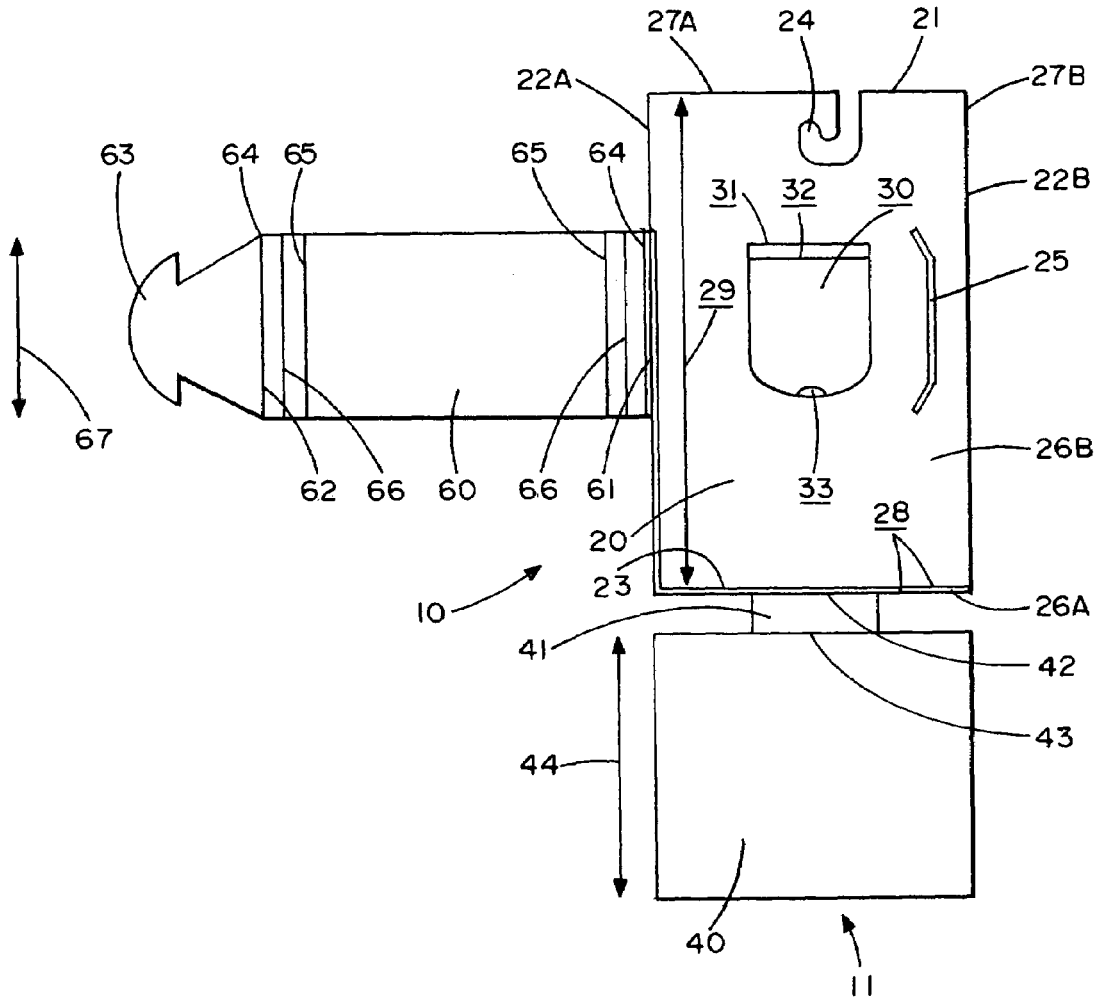
FIG. 2 is a top plan view of the garment display package shown in FIG. 1, showing a one-piece component forming the entire shell of the present invention.
Figure 3:
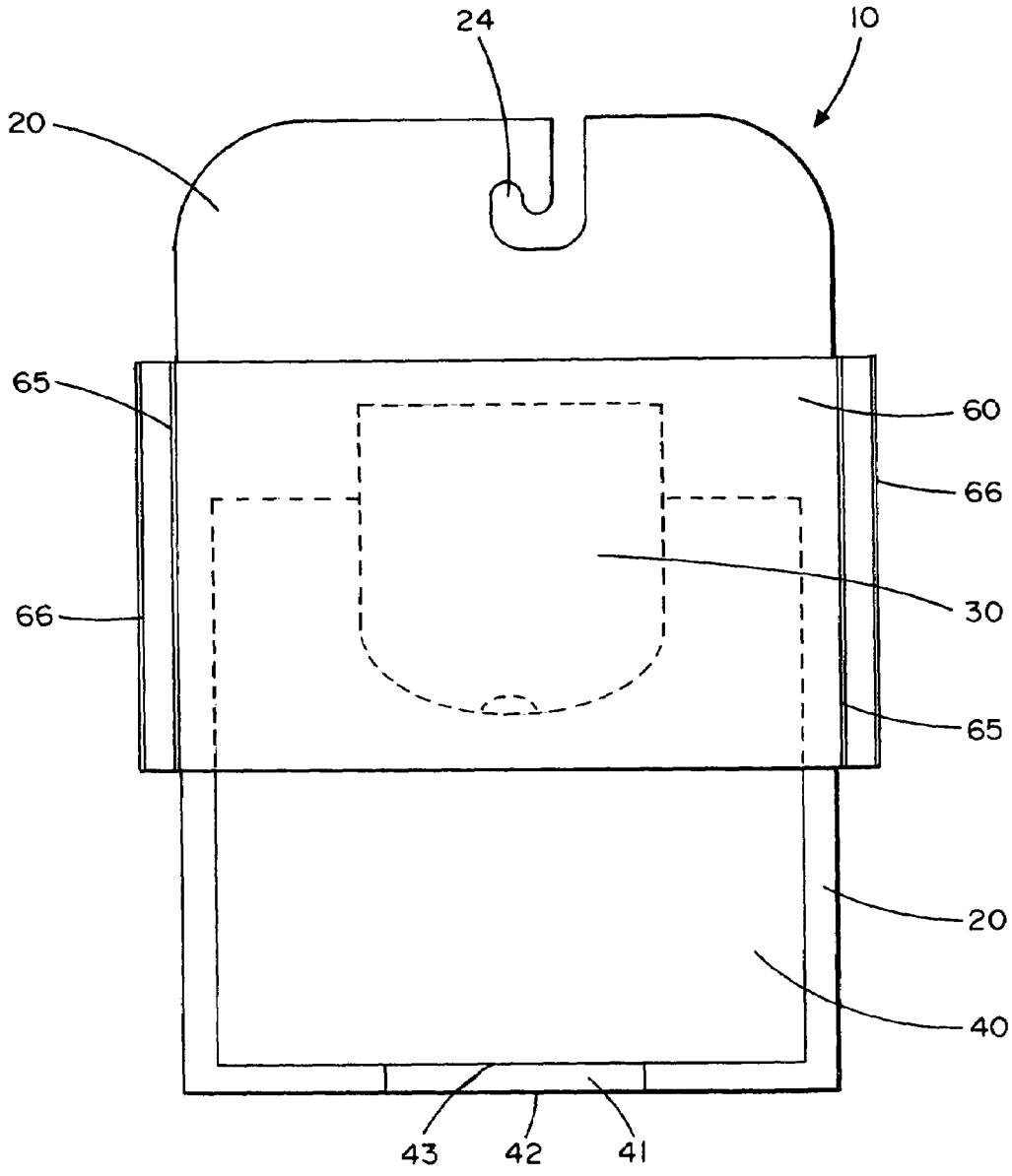
FIG. 3 is a front elevational view of the garment display package shown in FIG. 1, illustrating a bottom panel in upwardly folded juxtaposed relationship with a back panel being secured in place by a securing flap.
Figure 4:
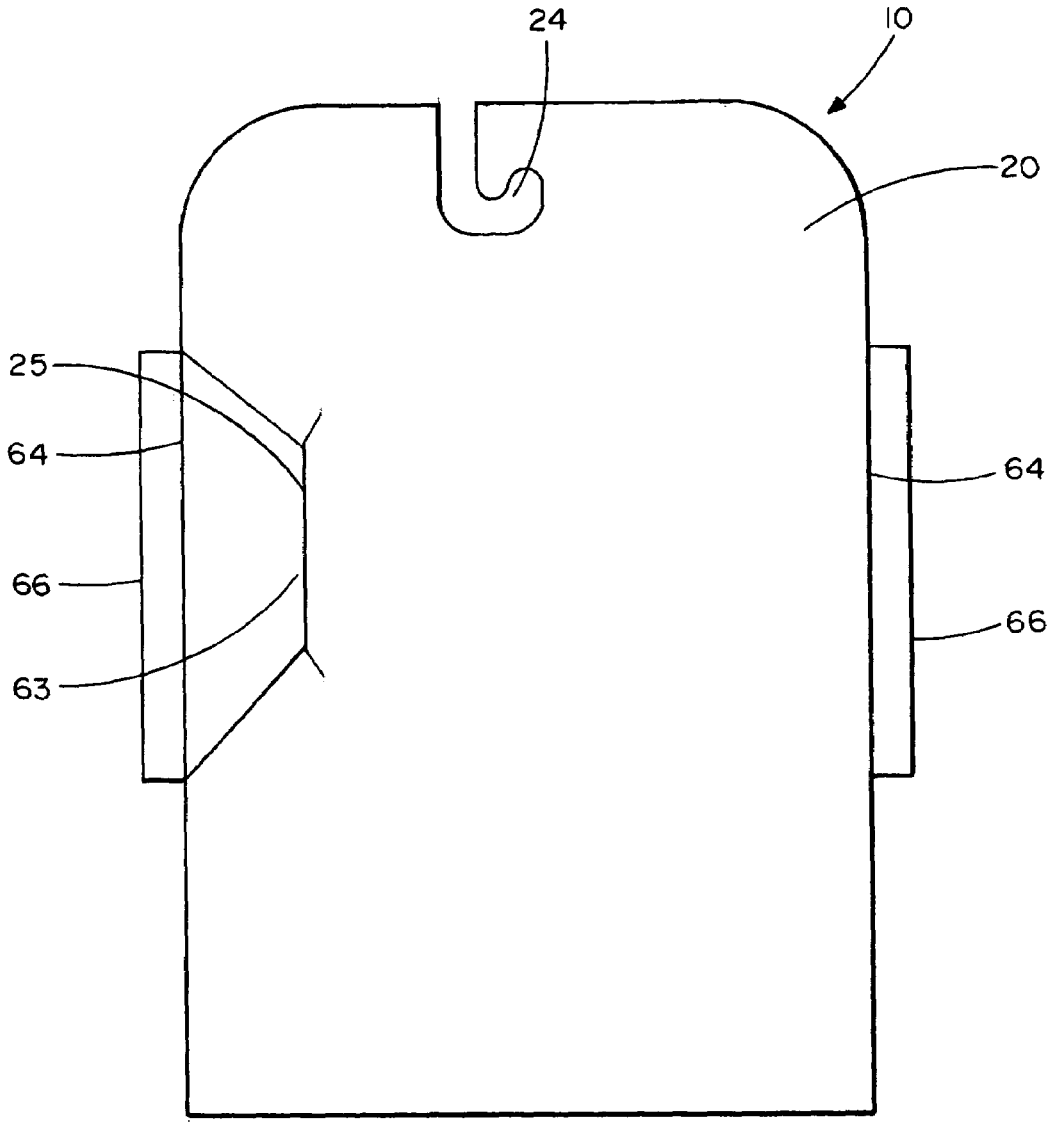
FIG. 4 is a back view of the garment display package shown in FIG. 1, illustrating a closing tab inserted into a corresponding closing slot in a back panel.
Figure 5:
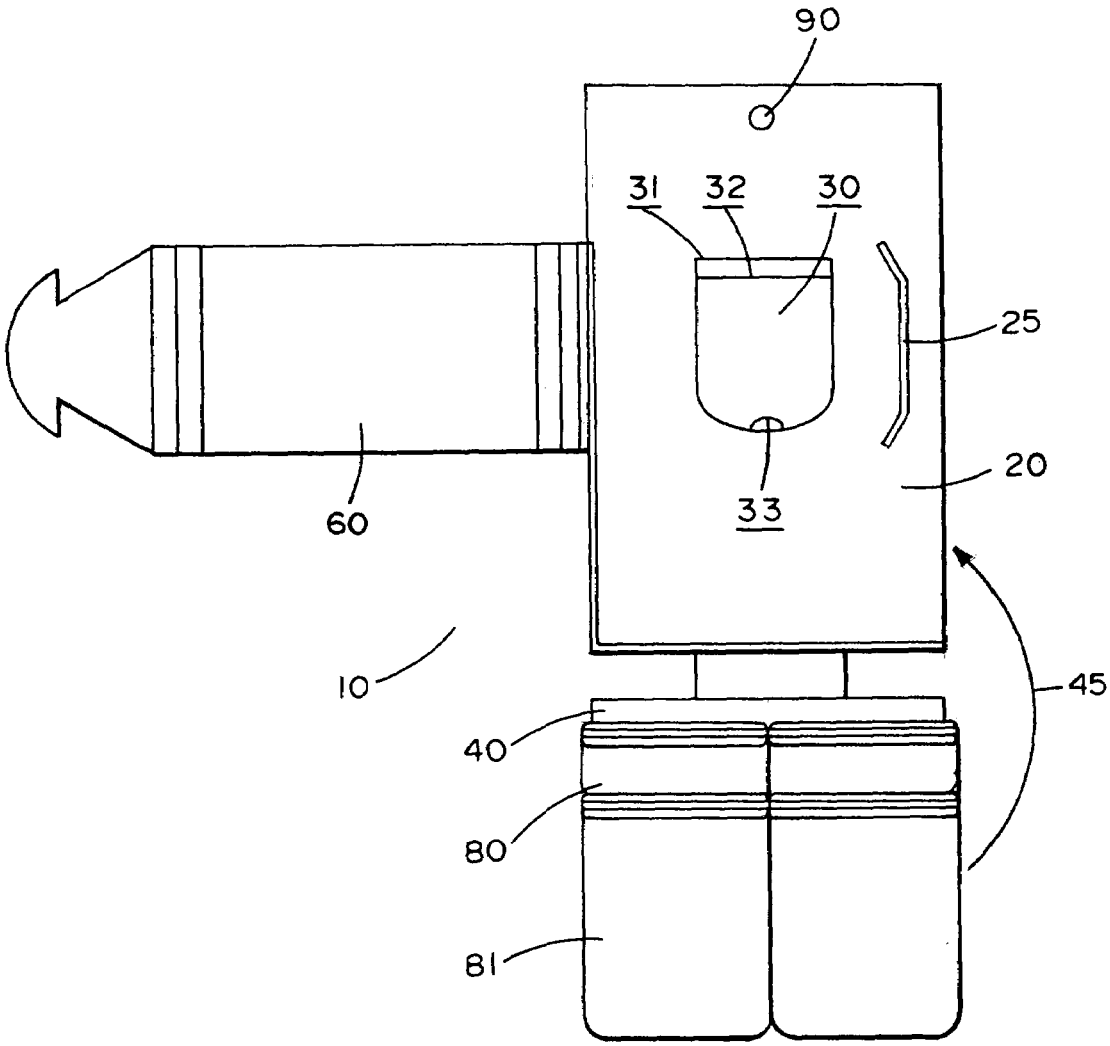
FIG. 5 is a top plan view of one embodiment of a garment display package of the present invention showing an aperture as a hanging tab, a securing flap, and multiple garments positioned about a bottom panel in its downward and unfolded position.

An embodiment of a garment display package 10 of the present invention as seen in FIGS. 1-5, and with particular reference to FIGS. 2 and 5, comprises a back panel 20, a bottom panel 40, and a front panel 60. The garment display package 10 of the present invention may be formed from a single, preferably cardboard, blank 11. The back panel 20 includes a top 21, two sides 22A and 22B, a bottom 23, a hanging tab 24 integrally formed at or near the top 21, a securing flap 30 integrally formed in back panel 20, and a closing slot 25 formed proximate one side 22B of back panel 20. The bottom panel 40 is foldably connected to the bottom 23 of the back panel 20 and is upwardly foldable into juxtaposed relationship with the back panel 20. The front panel 60 comprises an innermost edge 61 and an outermost edge 62. The innermost edge 61 of front panel 60 is foldably connected to side 22A of back panel 20, which is opposite the side on which closing slot 25 is located. Front panel 60 also includes a closing tab 63 corresponding to the closing slot 25, and is foldably connected to outermost edge 62 of front panel 60. Such an embodiment of the present invention allows at least one garment 80, 81, as seen in FIGS. 1 and 5, to be displayed about/around bottom panel 40 in an upwardly folded position. Such an embodiment also allows front panel 60 to be folded across a top portion of the outer perimeter of garments 80, 81, and closing tab 63 to be inserted into closing slot 25 so as to secure garments 80, 81 within the package. Closing slot 25 and closing tab 63 may have corresponding shapes. For example, both closing tab 63 and closing slot 25 may be arcuate in shape.

Displayed garments may be any articles, particularly clothing articles, desired to be viewed and touched by potential customers that fit appropriately sized garment display packages as in the present invention. As an example, displayed garments 80, 81 are intimate apparel, such as underwear.

Figure 6:
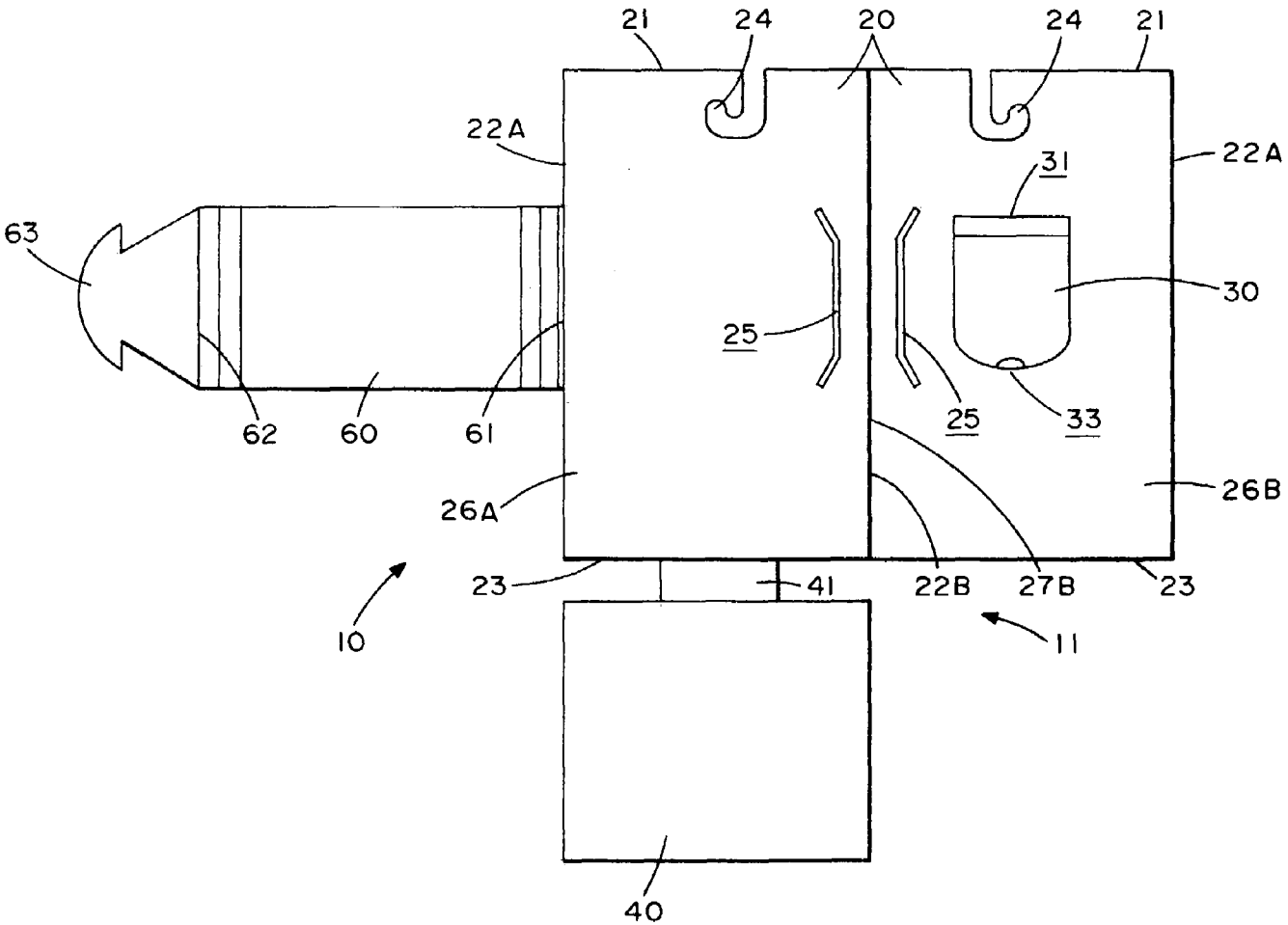
FIG. 6 is a top plan view of the embodiment of the garment display package shown in FIG. 2, showing the inner portion and outer portion of the back panel.

As shown in the embodiment in FIG. 6, the back panel 20 of the garment display package 10 comprises an outer portion 26A and an inner portion 26B of approximately equal size. The first or inner portion 26B and second or outer portion 26A may be folded together along back panel fold line 27A or 27B so that the two portions are in substantial alignment with one another. The two portions 26A and 26B may be permanently fixed together with a fixation means, for example by gluing, to provide a composite back panel having a double thickness to it. A double thickness back panel 28 as depicted in FIGS. 2 and 5 provides additional support to hanging tab 24 and closing slot 25 formed therein. A double thickness back panel 28 also allows a securing flap 30 to be integrally formed in, or cut from, only the inner portion 26B of back panel 20. While securing flap 30 may be formed in or cut from both portions 26A and 26B, it is preferably formed in or cut from only inner portion 26B. Preferably, securing flap 30 is integrally formed and foldably attached to inner portion 26B of back panel 20 along fold line 31. One or more additional fold lines 32 may also be present proximate fold line 31 to provide a package thickness that allows securing flap 31 to accommodate thick, folded, and/or multiple garments for display. Furthermore, if securing flap 31 is present, outer portion 26A and inner portion 26B should be fixed together, if at all, in a manner that allows the securing flap 30 in inner portion 26B to be unattached to, and separable from, outer portion 26A. Notch 33 is also preferably cut from securing flap 30 so as to enable securing flap 30 to be easily separated and lifted from its position within inner portion 26B.

Hanging tab 24 of the present invention is preferably formed as a hook having a substantially "J" shape, as shown in FIGS. 1-4. Alternatively, hanging tab 24 may be an aperture 90 having a substantially circular or oblong shape, as shown in FIG. 5.

An embodiment of the present invention may include bottom panel 40 that is foldably connected to the bottom 23 of the back panel 20 with a connecting tab 41. Connecting tab 41 has a common fold line 42 with back panel 20 and a separate common fold line 43 with bottom panel 40 so that folding connecting tab 41 along each fold line 42, 43 provides a package thickness dimension. Such a package thickness dimension allows a garment display package 10 of the present invention to display thicker garments, as well as multiple garments, and particularly multiple folded garments, such as 80, 81 as shown in FIGS. 1 and 5.

In the present invention, front panel 60 may comprise at least two fold lines 64, 65 located proximate each of the innermost edge 61 and the outermost edge 62 of front panel 60. Fold lines 64, 65 located proximate each edge are spaced apart so that folding front panel 60 at fold lines 64, 65 provides a thickness dimension to accommodate various garments for display. In a preferred embodiment, front panel 60 comprises at least three fold lines 64, 65, 66 located proximate each of innermost edge 61 and outermost edge 62. One of the at least three fold lines located proximate each edge is an intermediate fold line 66 positioned between a rearward fold line 64 and a forward fold line 65 at each edge 61, 62. In a preferred embodiment, three fold lines 64, 65, 66 located proximate each edge are spaced apart so that folding front panel 60 along the at least three fold lines 64, 65, 66 provides a variable thickness dimension to accommodate various garments for display. That is, intermediate fold line 66 near each edge 61, 62 is capable of flexing to allow front panel 60 to accept garments of different thicknesses.

In an embodiment of the present invention, back panel 20 has a length 29, bottom panel 40 has a length 44, and front panel 60 has a length 67. The length 67 of front panel 60 is less than the length 29 of back panel 20, and front panel 60 is foldably connected to back panel 20 along a portion of length 29 of back panel 20. In such a preferred configuration, when front panel 60 is folded across a top portion of the outer perimeter of garment(s) 80, 81 in their upwardly folded position, part of the garment(s) 80, 81 are exposed below front panel 60 for display. Such an embodiment enables consumers to visually and tactilely inspect the displayed garment(s), without needing to open the package to do so.

The present invention provides methods for using a garment display package that is foldable, hangable on a display rack, and that allows consumers to both visually and tactilely inspect garments that are displayed in a closed package. An embodiment of a method for using a foldable garment display package according to the present invention comprises first providing a garment display package 10 having a back panel 20, a bottom panel 40, and a front panel 60. Back panel 20 has a top 21, two sides 22A and 22B, a bottom 23, a hanging tab 24 integrally formed at top 21, a securing flap 30 integrally formed in back panel 20, and a closing slot 25 formed proximate one side 22B of back panel 20. Bottom panel 40 is foldably connected to the bottom 23 of back panel 20 and is upwardly foldable into juxtaposed relationship with back panel 20. Front panel 60 has an innermost edge 61 and an outermost edge 62, wherein the innermost edge 61 is foldably connected to the side 22A of back panel 20 opposite closing slot 25. Front panel 60 also includes a closing tab 63 corresponding to closing slot 25, wherein closing tab 63 is foldably connected to the outermost edge 62 of front panel 60.

Such an embodiment comprises positioning at least one garment 80, 81 about/around bottom panel 40; flipping securing flap 30 up and out of the way of the area where the bottom panel 40 will be folded up into juxtaposed relationship with the back panel 20; folding bottom panel 40 and the garments 80, 81 wrapped therearound upward into juxtaposed relationship with back panel 20; flipping securing flap 30 down over the top of bottom panel 40 and the one or more garments 80, 81 wrapped therearound to help secure them in their upwardly folded position and to help keep dust and debris from settling on the garments 80, 81; folding front panel 60 transversely across a top portion of the outer perimeter of garments 80, 81 and bottom panel 40; inserting closing tab 63 into the corresponding closing slot 25 in back panel 20 to secure garments 80, 81, bottom panel 40, securing flap 30, and front panel 60 into position for displaying; and placing the hanging tab 24 over a display rack rod (not shown). Portions of the displayed garments, which may be intimate apparel, are exposed below the front panel 60 of the closed package 10, and are thereby readily accessible to customers for both viewing and touching. Therefore, there is no real need for customers to open the packaging 10 to inspect the garments 80, 81 contained therein.

In an embodiment, a method for using a foldable garment display package as in the present invention also comprises a bottom panel 40 foldably connected to the bottom 23 of back panel 20 via connecting tab 41, wherein connecting tab 41 has a common fold line 42 with back panel 20 and a separate common fold line 43 with bottom panel 40. The step of folding bottom panel 40 and garment(s) 80, 81 upward into juxtaposed relationship with back panel 20 further comprises folding connecting tab 41 along each fold line 42, 43 to provide a package thickness dimension. Such a package thickness dimension allows a garment display package 10 of the present invention to display thicker garments, as well as multiple garments, and in particular, multiple folded garments, such as 80, 81 shown in FIGS. 1 and 5.

A method for using a foldable garment display package as in the present invention may also include providing front panel 60 having at least two fold lines 64, 65 located proximate innermost edge 61 and at least two fold lines 64, 65 located proximate outermost edge 62. Fold lines 64, 65 located proximate each edge 61, 62 are spaced apart. A step of folding front panel 60 transversely across a top portion of the outer perimeter of garment(s) 80, 81 and bottom panel 40 further comprises folding front panel 60 at fold lines 64, 65 to provide a thickness dimension so as to accommodate, thick, folded, and/or multiple garments for display.

In an embodiment, a foldable garment display package may include back panel 20, bottom panel 40, and front panel 60, having respective lengths 29, 44, and 67. Length 67 of front panel 60 is preferably less than length 29 of back panel 20. Front panel 60 is foldably connected to back panel 20 along a portion of length 29 so that when front panel 60 is folded across a top portion of the outer perimeter of garment(s) 80, 81, portions of the garment(s) are exposed below front panel 60, enabling display of garments 80, 81 for visual and tactile inspection by consumers.

An embodiment of a method according to the present invention that includes positioning at least one garment about/around bottom panel 40, as described above, may further comprise positioning at least two garments about/around bottom panel 40. Each of the at least two garments, for example 80, 81, may be folded about varying locations along length 44 of bottom panel 40 so that each garment 80, 81 is displayed in a layered fashion.

Although the present invention has been described with reference to particular embodiments, it should be recognized that these embodiments are merely illustrative of the principles of the present invention. Those of ordinary skill in the art will appreciate that the garment display package and method for use of the present invention may be implemented in other ways and embodiments. Accordingly, the description herein should not be read as limiting the present invention, as other embodiments also fall within the scope of the present invention.

What is claimed is:

1. A garment display package, comprising:

a back panel having a top, two sides, and a bottom, the back panel having a securing flap integrally formed therein, a hanging tab integrally formed at the top, and a closing slot formed proximate one side;

a foldable connection between the securing flap and the back panel and at least one fold line proximate the foldable connection so that folding the securing flap at the at least one fold line provides a thickness dimension to accommodate garments having various thicknesses for display;

a bottom garment support panel foldably connected to the bottom of the back panel with a connecting tab and upwardly foldable into juxtaposed relationship with the back panel, the connecting tab having a common fold line with the back panel and a separate common fold line with the bottom garment support panel so that folding the connecting tab along each fold line provides a package thickness dimension; and a front panel foldable only about a top portion of at least one garment and the upwardly folded bottom garment support panel, the front panel having an innermost edge and an outermost edge, the innermost edge of the front panel foldably connected to the side of the back panel opposite the closing slot, a closing tab having a shape corresponding to the shape of the closing slot in the back panel foldably connected to the outermost edge of the front panel, and at least two fold lines located proximate each of the innermost edge and the outermost edge, the at least two fold lines located proximate each edge spaced apart so that folding the front panel at the fold lines provides a thickness dimension to accommodate garments having various thicknesses for display, wherein the garment is positioned about the bottom garment support panel in upwardly folded position, the securing flap is folded over the garment and the upwardly folded bottom garment support panel, the front panel is folded across the securing flap, the top portion of the garment, and the upwardly folded bottom garment support panel, and the closing tab is inserted into the closing slot to secure and display the garment within the package, and wherein the back panel further comprises an outer portion and an inner portion of approximately equal size, the inner portion foldably connected to and permanently fixed to the outer portion to provide a composite back panel having double thickness.

2. The garment display package of claim 1, wherein the securing flap is integrally formed in only the inner portion of the back panel.

* * * * *